US008650804B2

(12) United States Patent
Skoretz

(10) Patent No.: US 8,650,804 B2
(45) Date of Patent: Feb. 18, 2014

(54) ROOFING VALLEY INSET

(76) Inventor: Dallas W. Skoretz, McDonald, TN (US)

( * ) Notice: Subject to any disclaimer, the term of this patent is extended or adjusted under 35 U.S.C. 154(b) by 271 days.

(21) Appl. No.: 13/100,341

(22) Filed: May 4, 2011

(65) Prior Publication Data

US 2011/0277391 A1 Nov. 17, 2011

Related U.S. Application Data

(60) Provisional application No. 61/334,795, filed on May 14, 2010.

(51) Int. Cl.
*E04D 13/04* (2006.01)
*E04D 13/064* (2006.01)

(52) U.S. Cl.
CPC ..... *E04D 13/064* (2013.01)
USPC ..... 52/13; 52/60; 52/97

(58) Field of Classification Search
USPC ..... 52/11, 13, 14, 58, 60, 97, 198, 199, 532
See application file for complete search history.

(56) References Cited

U.S. PATENT DOCUMENTS

| | | | | | |
|---|---|---|---|---|---|
| 661,870 | A * | 11/1900 | Hipparo | 52/13 |
| 1,765,121 | A * | 6/1930 | Audet | 52/282.1 |
| 2,258,078 | A * | 10/1941 | Tennison | 52/13 |
| 2,730,969 | A * | 1/1956 | Perry | 52/276 |
| 4,594,819 | A * | 6/1986 | Kneisel | 52/60 |
| 5,115,603 | A * | 5/1992 | Blair | 52/13 |
| 7,290,373 | B2 * | 11/2007 | Austin et al. | 52/95 |
| 2003/0159365 | A1 * | 8/2003 | Hutton | 52/13 |

* cited by examiner

*Primary Examiner* — William Gilbert
(74) *Attorney, Agent, or Firm* — Stephen J. Stark; Miller & Martin PLLC

(57) ABSTRACT

A roof valley inset provides a flexible material with angularly extending arms. Dividers may be useful to direct water toward respective arms in a base pan and the arms may taper, such as to a point away from the other arm. Dividers may be provided as permanently connected to the base pan or detachably connected for ease in shipping. The dividers may also have cantileveredly connected legs which extend above a portion of the arms to assist in covering shingles, when installed.

10 Claims, 7 Drawing Sheets

REPLACEMENT SHEET

ROOFING VALLEY INSET

CLAIM OF PRIORITY

This application claims the benefit of U.S. Provisional Patent Application No. 61/334,795 filed May 14, 2010.

FIELD OF THE INVENTION

The present invention relates to a roofing valley inset for use with installing new roofs as well as replacing roofs on buildings such as residential buildings and other applications.

DESCRIPTION OF RELATED ART

In the prior art, shingles were laid out in a particular manner over valleys such as with a weave. In an effort to provide fewer leaks, planar sheets of metal flashing were laid out in the valleys before putting down the shingles. Also sections of rolled rubber roofing have to be placed in a valley and then shingles installed thereover. However, even with these improvements many homeowners and others experience leaks in roof valleys. These "insets" have a smooth upper surface and are a substantially uniform thickness.

Accordingly, an improved roof valley inset and method of roofing and its use is believed to facilitate the installation of roofing in valleys.

SUMMARY OF THE INVENTION

Accordingly, it is an object of at least some embodiments of the present invention to provide a flexible roofing valley inset.

It is another object of at least some embodiments of the present invention to provide a roofing valley inset which facilitates water drainage while attempting to prevent back-flow underneath shingles thereby potentially causing a roof leak.

It is another object of at least some embodiments of the present invention to attempt to prevent overflow from water from one side of valley to the other side of the valley.

It is another object of at least some embodiments of the present invention to provide a trim and neat appearance at a valley utilizing an inset.

It is another object of at least some embodiments of the present invention to provide a roofing valley inset with a center insert possibly having heating capabilities thereby at least assisting the removal of frozen precipitation from the roofs of houses.

Accordingly, in accordance with a presently preferred embodiment of the present invention, a roofing valley inset can be provided which preferably provided as a length of flexible material that may be continuous from the bottom of the valley to the top of the valley which can provide under-layment in the area where two roof hips meet creating a valley between roof lines. The inset may provide first and second roof surfaces which meet at a slot in a base pan. The inset may otherwise be configured to be angularly positionable relative to one another to facilitate, at least in some embodiments, various angular relationships of one roof hip relative to another at the valley.

Additionally, the top of the base pan may include a divider possibly with an upward extension to facilitate a neat appearance with shingles installed as well as possibly facilitate the direction of the water down the roof instead of from one side of the roof to the other side at the valley.

The roof may be made of a recycled material and may be provided in more than one piece such as with a base pan such as a base pan, rib insert or otherwise. Colors can be selected to cooperate with the desires of the user. Furthermore, the base pan may have tapered edges leading upward from the valley to facilitate an attractive appearance. The base pan may also have an upper surface which at least assists in providing a channel to direct fluid down the roof to attempt to prevent fluid from continuing up a base pan upwardly from the valley in that direction. A slot in the base pan members can provide an ability for the inset to be rolled up into a roll as well as possibly facilitating angular positioning. At least some embodiments may have the capabilities to facilitate the removal of frozen precipitation from a roof.

BRIEF DESCRIPTION OF THE DRAWINGS

The particular features and advantages of the invention as well as other objects will become apparent from the following description taken in connection with the accompanying drawings in which:

FIG. 5B is a top plan view of the embodiments of FIGS. 1-4 shown with three tab style shingles installed thereon;

DETAILED DESCRIPTION OF THE DRAWINGS

Figure 1:
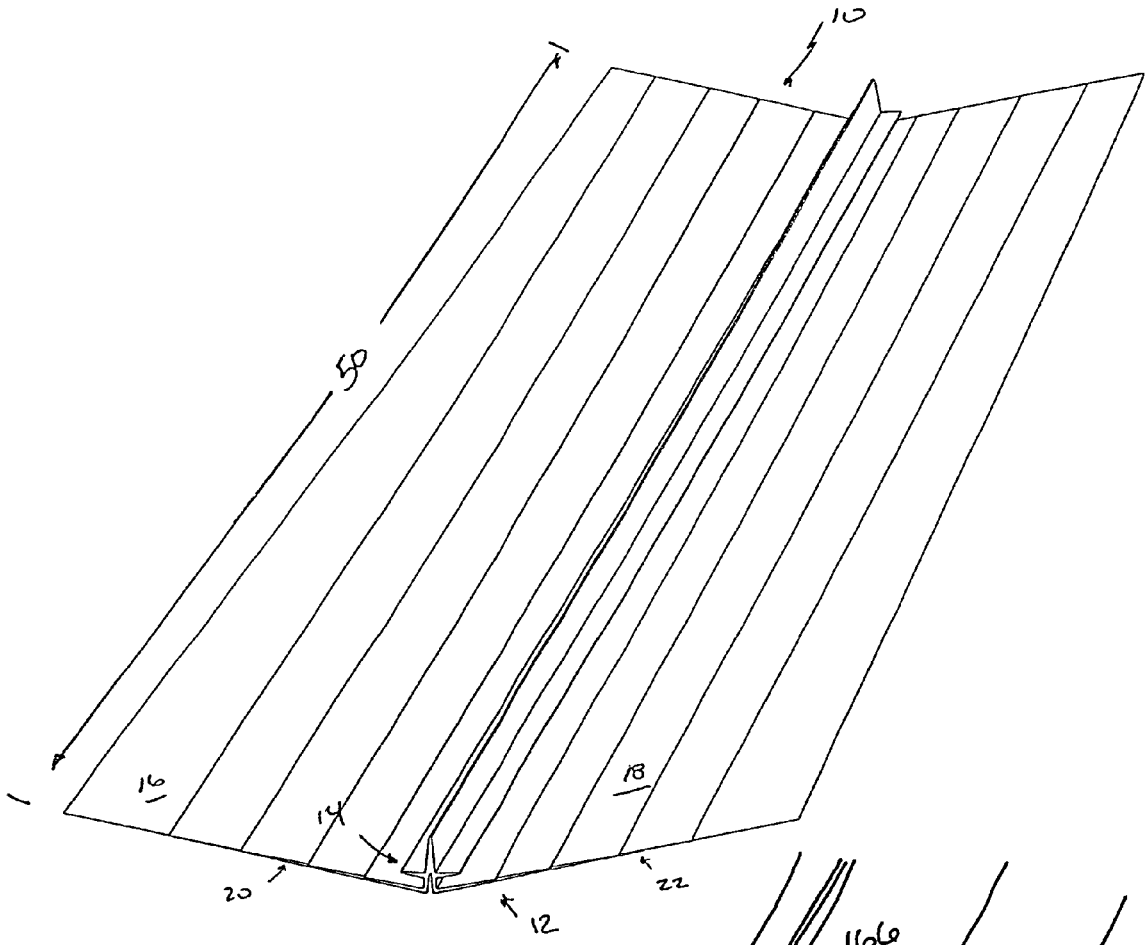
FIG. 1 is a top perspective view of the presently preferred embodiment of the present invention.

FIG. 1 shows a roof valley inset 10 in accordance with a presently preferred embodiment of the present invention.

Inset 10 may be made of plastic or any other suitable material (s) but in the presently preferred embodiment, can be provided to provide a sufficiently flexible state so that it can be provided in a rolled configuration from the manufacturer. Other embodiments could be provided in sections.

The inset 10 may be utilized to facilitate the installation of roofing around valleys where the two axes of roof hips meet (i.e., two roof portions meeting at an angle). This would be understood by those of ordinary skill in the art. The inset can be made of any sort of material such as recyclable material such as polyvinyl chloride, polyethylene, polyurethane, and/or various other materials.

Figure 5A:
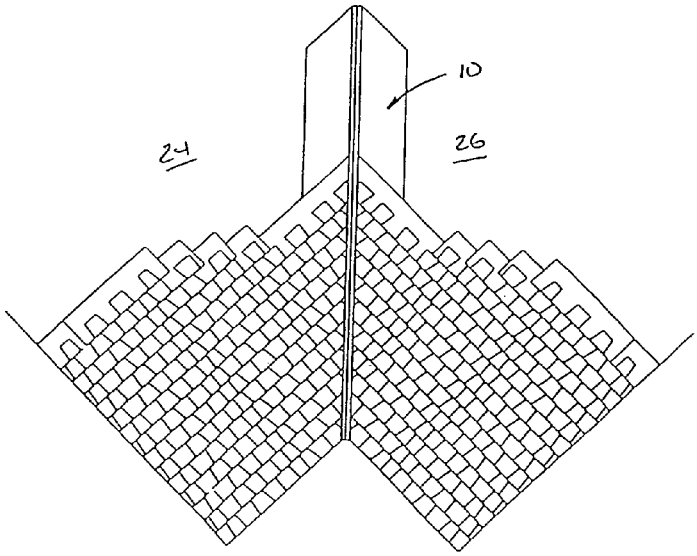
FIGS. 5A and 5B are top plan views of installed insets as shown in FIGS. 1-4 with dimensional style shingles.
Figure 5B:
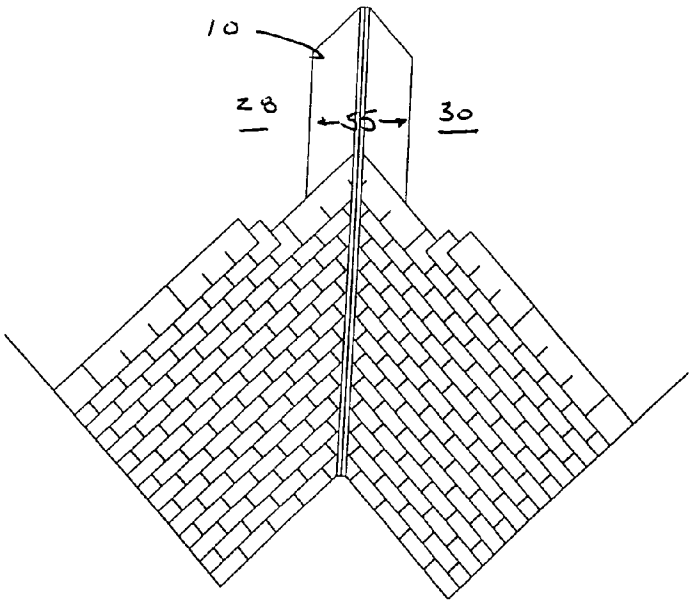

The inset illustrated may be comprised of base pan 12 and a rib 14 in many embodiments. The rib 14 and the base pan 12 may be integrally connected or detachably or otherwise connected to one another depending on the particular embodiment selected. The inset 10 illustrated has first and second upper surfaces 16,18 as well as first and second lower surfaces 20,22. Lower surfaces 20,22 are preferably installed against deck members such as deck members 24,26 and/or 28,30 such as shown in FIGS. 5A and 5B.

Figure 2A:
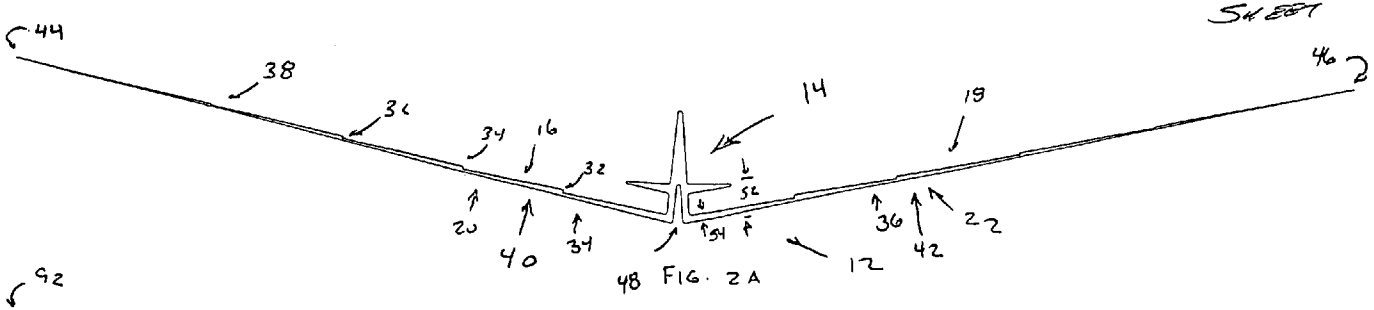
FIG. 2A is a cross-sectional view of the embodiment shown in FIG. 1.

FIG. 2A may be useful in viewing larger detail as it relates to this particular embodiment. In particular, steps 32,34,36,38 may be provided one each of first and second sides 34,36 of the base pan 36 such as on the upper surface 16,18 of the inset 10 or otherwise. The steps 32,34,36,38 are believed to assist in providing at least one if not a plurality of channels thereby to assist in directing moisture downwardly and/or prevent fluid going towards leading edges 44,46 to thereby potentially cause a roof leak.

Slot 48 may be useful to facilitate flexibility of the design in that the first and second sides 40,42 can be made substantially co-planar during a rolling operation to roll the inset along its length 50. Slot 48 could be a notch at an angular relationship or could simply be an angular relationship in some embodiments while the slot having a greater depth 52 or thickness 54 of the base pan proximate to the slot 48. The inset 10 can then be unrolled and installed. Slot 48 can also facilitate the angular positioning of sides 40,42 during installation.

Figure 2B:
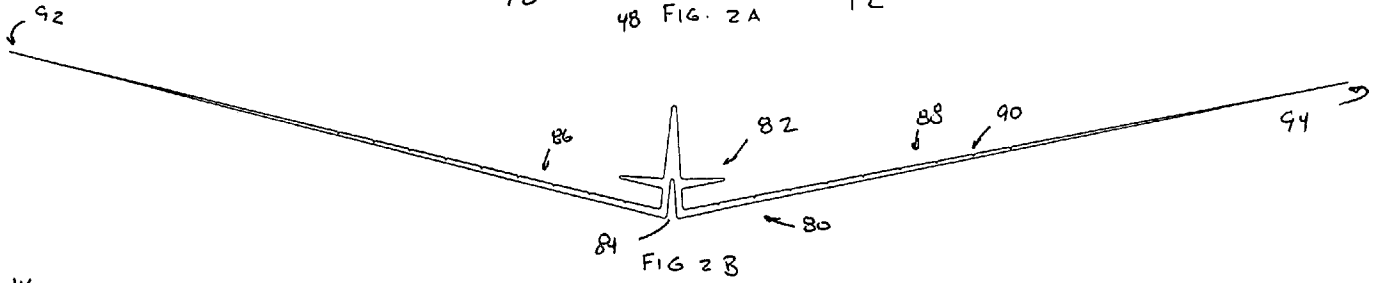
FIG. 2B is a cross-sectional view of a first alternatively preferred embodiment of the present invention.

FIG. 2B is a somewhat similar construction to that shown in FIG. 2A in that a base pan 80 is shown connected to a rib 82. Slot 84 is also illustrated. In this embodiment, upper surfaces 86,88 are provided with a plurality of grooves 90 to facilitate the direction of the water to present wicking up and beyond leading edges 92,94 from around the slot 84.

Figure 2C:
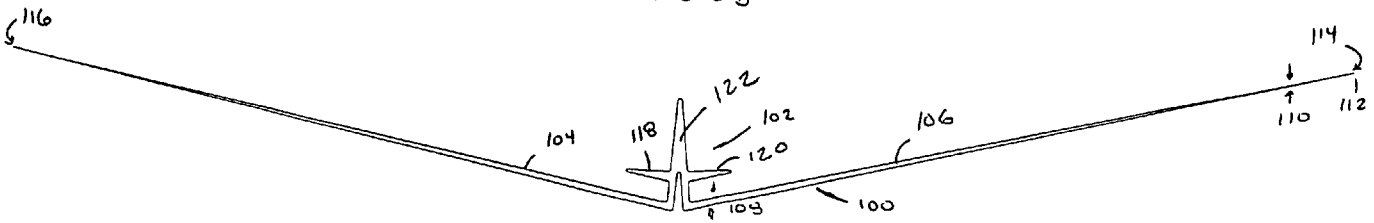
FIG. 2C is a cross-sectional view of a second alternatively preferred embodiment of the present invention.

FIG. 2C is somewhat similarly constructed of any of the embodiments 2A and 2B. Base pan 100 is shown connected to rib 102. This embodiment lacks the steps but shows the base pan arms 104,106 tapering from a first thickness 108 to a second thickness 110 which is significantly smaller or even to points 112 at the leading edges 114,116 at least for some embodiments.

All the embodiments of FIGS. 2A, 2B and 2C are shown having ribs 14,18,104 with having legs 118 and 120 which acts similar to trim to cover over inserted pieces of shingles such as is shown in FIGS. 5A and 5B thereby providing an attractive finished look while also preferably providing extension 122 thereabove to facilitate the directing of water from one roof portion such as roof portion 30 and/or roof portion 28 to stay on a particular side of the roof as it comes from and not to tend to run over towards the other side.

Figure 3A:
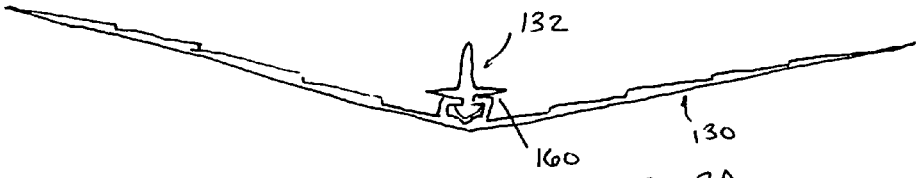
FIG. 3A is a cross-sectional view of a third alternatively preferred embodiment of the present invention.
Figure 3B:
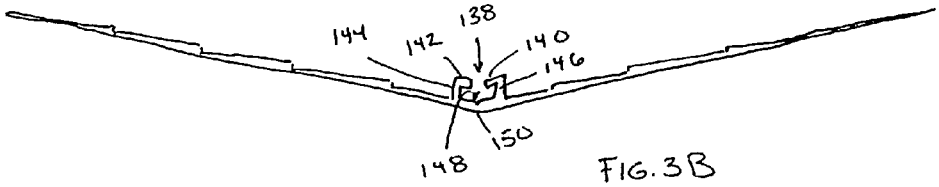
FIG. 3B is a cross-sectional view showing the base pan shown in FIG. 3A.
Figure 3C:
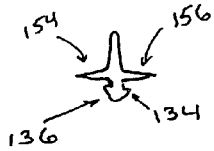
FIG. 3C is a cross-sectional view of the rib inset shown in FIG. 3A.

FIGS. 3A-3C show another embodiment of the third alternatively preferred embodiment of inset 132. Base pan 130 is shown connected to a rib 132. Rib 132 in this embodiment in the form of a removable or detachable rib. In this construction, a single base pan 130 construction could be provided and a variety of insets 132 could be provided as will be discussed below.

Specifically, insets 152 could be provided with various color selections and/or other options to coordinate with particular roofs. A single base pan 130 could coordinate with one of a selection of ribs 132. Furthermore, the design of FIG. 4B could be provided for at least some embodiments as will be explained below although those features could also be provided with the embodiments of FIGS. 1-2C and/or others.

The insert 132 preferably is provided with protrusions 134,136 which may act as a T lock within a T-slot 138 which may be defined as gap between the first and second tabs 140,142. First and second tabs may act as retaining tabs supported by platforms 144 and 146. Rounded edges 148 may be useful to provide increased strength. Other locking systems for connecting base pan 130 to rib 132 may be utilized with other embodiments.

Additionally, the embodiment of FIG. 3A-3C lack the slot at a bottom surface of the base pen 130 but instead provide a relief 150 at an upper portion which may be useful to facilitate the ability to roll the base pan 130 which is used to assist in providing the inset 150 of the embodiment shown in FIG. 3A. The legs 154 and 156 are shown illustrated adjacent to the tabs 140,142 and therefore assist to define retaining slots 158,160.

Figure 4:
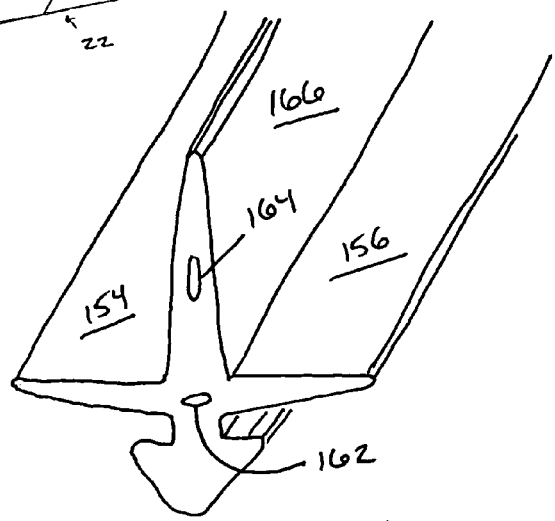
FIG. 4 is a top perspective view of an alternatively preferred embodiment of a rib inset shown in FIG. 3C.

FIG. 4 shows an alternatively preferred embodiment in which the first and second element 162,164 may be utilized. First and/or second elements 162,164 may resistance heating elements or other elements which can transfer heat into and on through extensions such as extension 166 and/or towards arms and possibly through arms 154,156 or at least a portion thereof thus providing heat. The elements utilized 162,164 are those such as are known in the art possibly utilized in connection with a thermostat and power source (not shown). When the temperature falls below a predetermined level, heat is provided to the elements 162,164 thereby melting any frozen precipitation thereon and/or its runoff.

By selecting an appropriate plastic and/or other material for the portions of the inset, then portions can be joined by fusion, welding, etc., to provide a continuous run or alternatively may provided by the manufacturer as a continuous run. Heat elements, etc., may or may not be employed with various embodiments. Furthermore, when selecting the appropriate plastic material, ultra-violet inhibiters can be provided in the material.

When selecting materials to provide for the inset 10, materials can be provided having a temperature rating from −50° to 150° Fahrenheit or other temperature range can be provided. The inset 10 may preferably provided with a predetermined width 55 as desired by the manufacturer. A plurality of widths could be provided in the various embodiments.

Figure 6:
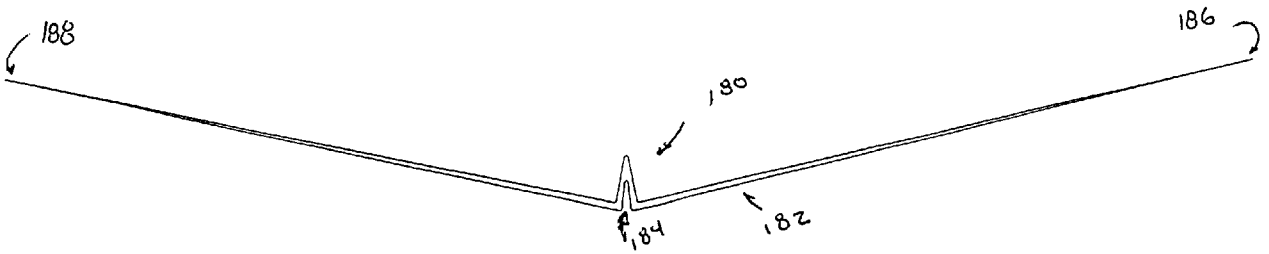
FIG. 6 is a cross-sectional view of a fourth alternatively preferred embodiment of the present invention.

FIG. 6 shows a fourth alternatively preferred embodiment which lacks the arms on rib 180 shown extending from base pan 182, slot 184. Taper towards leading ends 186,188 are illustrated in this embodiment.

Figure 7:
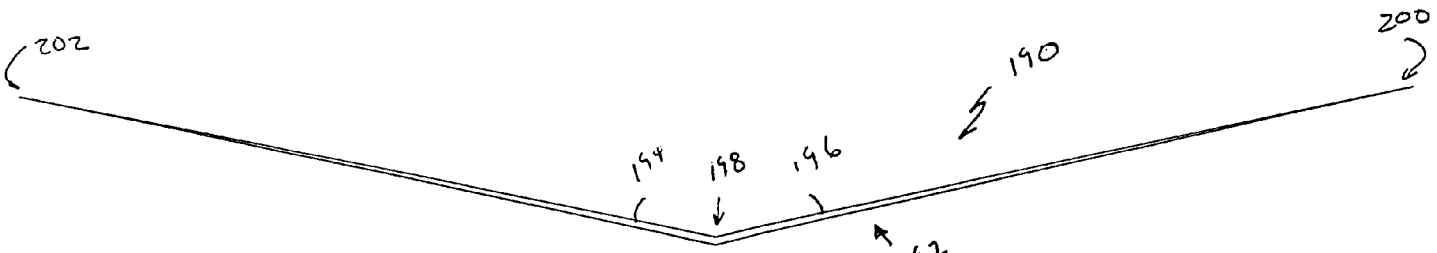
FIG. 7 is a cross-sectional view of a fifth alternatively preferred embodiment of the present invention.

A somewhat similar construction is provided for the embodiment of FIG. 7, except that no rib is provided. Essentially this inset 190 is a base pan 192 having first and second portions 194,196 meeting at a sharp angle 198. This design also has tapering ends 200,202 but need not be tapered through all embodiments. The design is preferably provided to be sufficiently flexible to accommodate rolling.

Figure 8A:
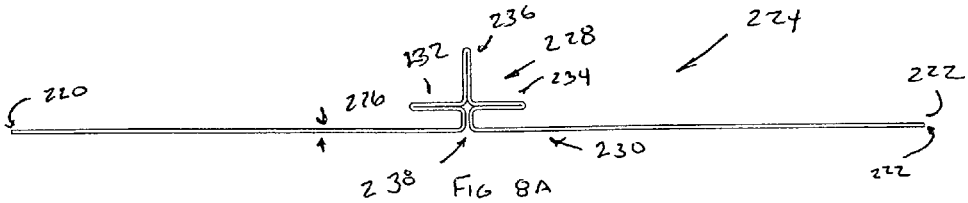
FIG. 8A is a cross-sectional view of a sixth alternatively preferred embodiment of the present invention.

FIG. 8A provides a somewhat different embodiment as this design may be formed from sheet material and does not have tapers at ends 220,222 of this inset 224. In fact, it may have a relatively constant thickness 226 throughout the unit. Specifically, the insert 22,24 may be formed by bending or otherwise providing the rib 228 relative to base pan 230. Legs 232 and 234 may be provided relative to extension 236.

Figure 8B:
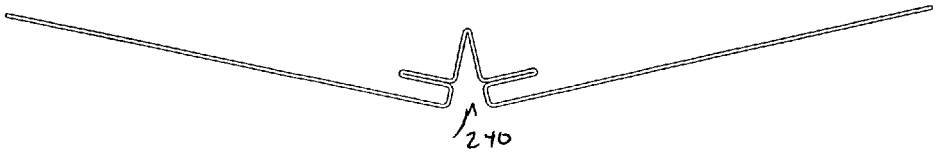
FIG. 8B is a cross-sectional view of a seventh alternatively preferred embodiment of the present invention.

The seventh alternatively preferred embodiment of FIG. 8B is somewhat similar except that the slot 240 is wider at a lower portion than at an upper portion as opposed to a slot 238 as provided in the embodiment of FIG. 8A. Furthermore, the embodiment of FIG. 8B may be the embodiment of FIG. 8A simply pulled and shaped to accommodate a particular valley for at least some embodiments.

Figure 9A:
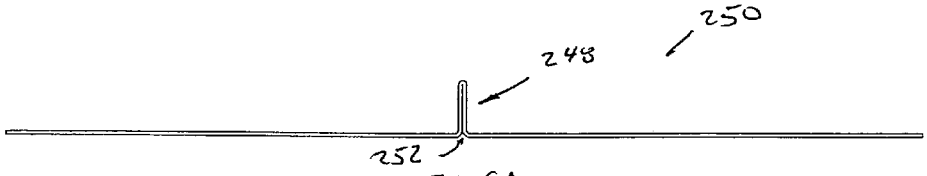
FIG. 9A is a cross-sectional view of an eight alternatively preferred embodiment of the present invention.
Figure 9B:
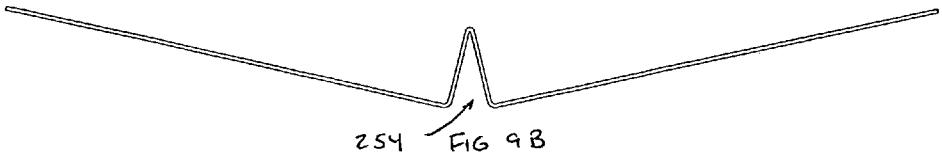
FIG. 9B is a cross-sectional view of a ninth alternatively preferred embodiment of the present invention.

The embodiment of FIGS. 9A and 9B may be somewhat similar or dissimilar to that of FIGS. 8A and 8B except that they lack the legs 232,234. Accordingly, a rib 248 is shown on inset 250,252 as opposed to a more definable slot 254 as shown in the embodiment of FIG. 9B then slot 252 of FIG. 9A.

Figure 10:
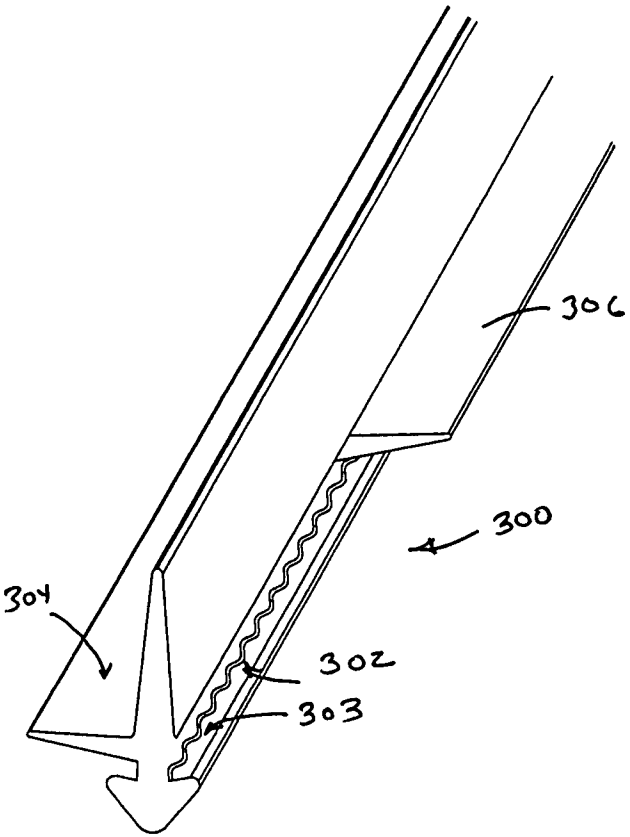
FIG. 10 is a top perspective view of a rib inset embodiment somewhat similar to that shown in FIGS. 3C and 4.

FIG. 10 shows a rib insert 300 of an alternative embodiment. This insert is shown having notches 302 formed into a lower side 303 below the arm 306. The second arm may or may not be provided with similar notches 302. A portion of arm 306 has been removed to show the notches 302 which would otherwise be substantially obscured from view in this figure.

Figure 11:
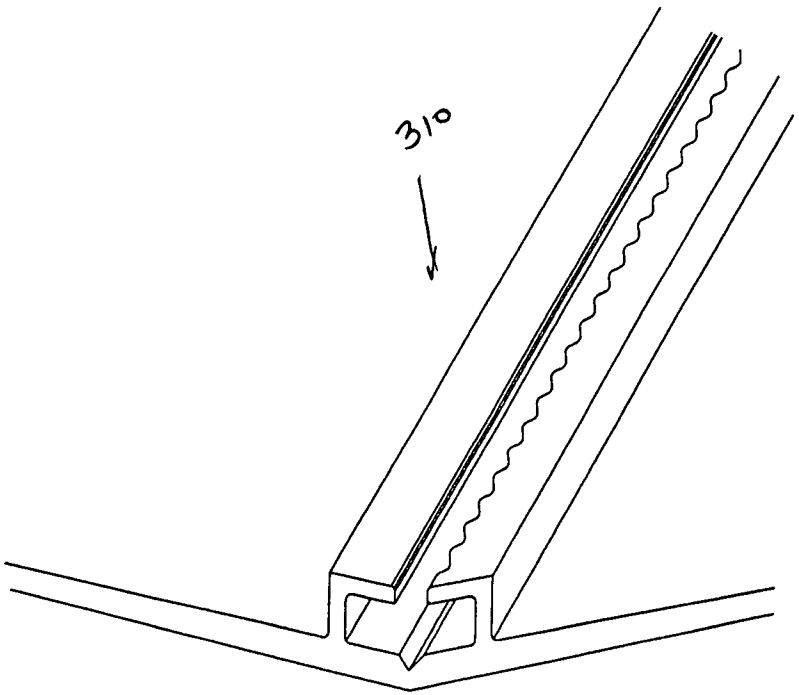
FIG. 11 is a top perspective view of a base pan embodiment somewhat similar to that shown in FIG. 3B.

FIG. 11 shows a base pan 310 which also has a series of notches 312 which cooperate with the notches 302 of the insert 300. These cooperating notches 302,312 can prevent sliding of the insert 300 relative to the base pan 310 once installed as is shown and described above relative to other embodiments, if utilized, as would be understood by those of ordinary skill in the art.

Some embodiments may utilize adhesives or sealants to assist in retaining the base pan 310 to the insert 300. Other embodiments may use mechanical connectors such as one or more fastening devices or fasteners which may pass through both the base pan 310 as well as a portion of the insert 300. Fasteners could be installed horizontally through platforms 314,316 or other portion of the base pan 310 and through lower side portion 303 of the insert 300, or other portion.

Figure 12:
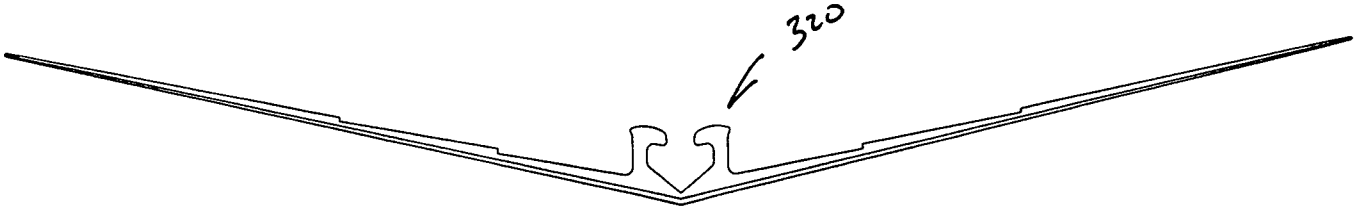
FIG. 12 is a front plan view of another base pan embodiment somewhat similar to those shown in FIGS. 3B and 11.
Figure 13:
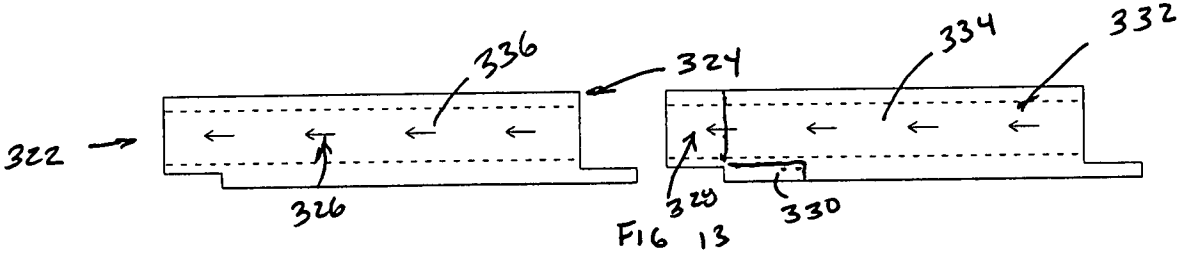
FIG. 13 is a side plan view with the arms folded upwardly of base pans constructed similarly to that of FIG. 12.

FIG. 12 provides another base pan 320 embodiment which can be utilized to provide an overlapping feature on opposing ends 322, 324. Singular units can then be joined together such as is about to occur in FIG. 13 while providing a weather resilient joint. Flow directions could be provided with markings 326. Inset reliefs 328,330 external to arm 332 (as well as opposing arm) allow for overlapping end 324 to be received therein to provide at least a substantially continuous outer surface 334 and 336 when installed for at least some embodiments.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A roof inset for installing in roofing valleys comprising:

a flexible base pan having first and second base pan arms connected together and extending outwardly and angularly away from one another, said base pan arms having upper surfaces configured to contact installed roofing shingles, and lower surfaces configured to contact the roof below the shingles, and said base pan arms taper to a smaller thickness in a direction away from the other arm, said base pan arms meeting at a slot;

a detachable divider retained by a connector portion of the base pan at the slot; and wherein the detachable divider provides a protrusion, and the protrusion is received in the slot at least partially defined with retaining tabs in the base pan.

2. The roof inset of claim 1 wherein the arms taper to a point at ends.

3. The roof inset of claim 1, the divider having cantileveredly connected legs extending over a portion of the arms.

4. The roof inset of claim 3 further comprising an upwardly directed extension above the legs.

5. The roof inset of claim 1 further comprising a slot below the divider extending upwardly relative to the lower surfaces of the arms.

6. The roof inset of claim 1 further comprising a plurality of steps on the upper surfaces of the arms.

7. The roof inset of claim 1 further comprising a plurality of channels in the arms.

8. The roof inset of claim 1 wherein the base pan is a plastic material.

9. A roof valley inset for installing in roofing valleys comprising:

a flexible plastic base pan having first and second base pan arms connected together at a detachable divider retained at a connector portion in the base pan said base pan arms having upper surfaces configured to contact installed roofing shingles, and lower surfaces configured to contact the roof below the shingles, and said divider upwardly extending relative to the arms and providing cantileveredly connected legs over at least a portion of the arms.

10. The roof valley inset of claim 9 wherein said base pan arms taper to a smaller thickness in a direction away from the other arm.

* * * * *